US010271143B2

(12) United States Patent
Seo

(10) Patent No.: US 10,271,143 B2
(45) Date of Patent: Apr. 23, 2019

(54) LINEAR ACOUSTIC TRANSDUCER

(71) Applicant: BUJEON CO., LTD., Ansan, Gyeonggi-do (KR)

(72) Inventor: Dong Hyun Seo, Ansan (KR)

(73) Assignee: BUJEON CO., LTD., Ansan-si, Gyeonggi-do (KR)

( * ) Notice: Subject to any disclaimer, the term of this patent is extended or adjusted under 35 U.S.C. 154(b) by 0 days.

(21) Appl. No.: 15/751,025

(22) PCT Filed: Dec. 29, 2015

(86) PCT No.: PCT/KR2015/014397
§ 371 (c)(1),
(2) Date: Feb. 7, 2018

(87) PCT Pub. No.: WO2017/026600
PCT Pub. Date: Feb. 16, 2017

(65) Prior Publication Data

US 2018/0234769 A1 Aug. 16, 2018

(30) Foreign Application Priority Data

Aug. 7, 2015 (KR) ..... 10-2015-0111428

(51) Int. Cl.

| | |
|---|---|
| ***H04R 1/40*** | (2006.01) |
| ***H04R 7/16*** | (2006.01) |
| ***H04R 9/02*** | (2006.01) |
| ***H04R 9/04*** | (2006.01) |

(52) U.S. Cl.
CPC ..... *H04R 7/16* (2013.01); *H04R 1/40* (2013.01); *H04R 9/02* (2013.01); *H04R 9/04* (2013.01)

(58) Field of Classification Search
CPC ... H04R 7/16; H04R 1/40; H04R 9/02; H04R 9/04
USPC ..... 381/398
See application file for complete search history.

(56) References Cited

U.S. PATENT DOCUMENTS

2009/0190791 A1 7/2009 Unruh et al.

FOREIGN PATENT DOCUMENTS

| | | | |
|---|---|---|---|
| JP | 09-168199 | A | 6/1997 |
| JP | 2008-042615 | A | 2/2008 |
| JP | 2011-015270 | A | 1/2011 |
| KR | 10-2010-0042178 | A | 4/2010 |

*Primary Examiner* — Sean H Nguyen
(74) *Attorney, Agent, or Firm* — Novick, Kim & Lee, PLLC; Jae Youn Kim

(57) ABSTRACT

Provided is a linear acoustic transducer for transducing an electrical signal into an acoustic signal and, more specifically, to a linear acoustic transducer, which can efficiently deliver the vibration energy of a driver by connecting a driving rod, to which a plurality of diaphragms are fixed, to the center of the driver and has partitions integrally formed inside a housing at regular intervals such that the partitions are located between the plurality of diaphragms, thereby generating an acoustic signal by compressing or expanding the air between the diaphragms and the partitions when the plurality of diaphragms vibrate upward and downward by the vibration of the driving rod.

14 Claims, 16 Drawing Sheets

LINEAR ACOUSTIC TRANSDUCER

TECHNOLOGY FIELD

The present invention relates to a linear acoustic transducer for converting an electrical signal into an acoustic signal, and more specifically, to a linear acoustic transducer, which can be efficiently vibrated of the driver's vibration energy by connection a driving rod which is fixed a plurality of diaphragms, to the center of the drive, thereby generating an acoustic signal by compressing or expanding the air between the above diaphragms and the partitions which are located among a plurality of the above diaphragms.

BACKGROUND OF THE INVENTION

In general, acoustic transducer is the device to output an acoustic signal which is received in electrical format, to convert an electrical energy into a mechanical energy due to voice coil which is existed in air gaps of magnetic circuit by Fleming's left-hand rule, i.e., when electrical signal containing various frequency apply to voice coil, it generates mechanical energy according to the current intensity and frequency amplitude, vibrates diaphragms then eventually generates acoustic pressure which can be noticed by human ears.

Such as this acoustic transducer is to generate acoustic pressure, forming air gaps with embodiment of the magnet and the upper plate inside of yoke, by connection of driver which consists of voice coil to develop magnetic flux inter-linkage in the air gap and diaphragms which is adhesive fixed on the frame.

Such as this acoustic transducer closely relates to volumetric displacement of the diaphragms. i.e., the output of transducer shall be increasing as the volumetric displacement is bigger. Thus, when to make higher output of acoustic transducer, it is necessary to expand the size of diaphragm, or increase rectilinear displacement of diaphragms, or increase the above both. According to these, up to now, transducer which consists of wide area diaphragms has been deployed to regenerate lower frequency acoustic.

But, to accommodate the diaphragms which have wide area, it causes additional expense and inefficiency because of big sized housing. Especially, there are difficulties for a slim acoustic transducer. For example, it was difficult for the conventional whooper speaker to adapt to slim electronic products such as plat panel television or computer monitor, because of its big volume.

Meanwhile, it is recently developed the linear array transducer apparatus, to drive a plurals of diaphragms through two driving rods. For example, "ACOUSTIC TRANSDUCER INCLUDING A PLURALS OF AXIAL ARRAY DIAPHRAGMS" is presented in REP. OF KOREA PATENT DISCLOSURE 10-2007-0035494.

As shown in FIG. 16, the conventional acoustic transducer is deployed with 1st driving rod and 2nd driving rod in inside of housing. And a plurality of 1st diaphragms is fixed at the above 1st driving rod and a plurality of 2nd diaphragms is fixed at the above 2nd driving rod. And the above 1st driving rod is connected with $1^{st}$ driver and the above 2nd driving rod is connected with 2nd driver Especially, in the conventional linear acoustic transducer, a plurals of 1st diaphragms and 2nd diaphragms are deployed above and below alternately at inside of housing. And, the above 1st and 2nd driving rod are parallel deployed each other at regular interval. And 1st driving rod is fixed penetrating 1st diaphragms and 2nd driving rod is fixed penetrating 2nd diaphragms. These conventional acoustic transducer can generate acoustic pressure, due to compression or expansion air between the above 1st diaphragms and $2^{nd}$ diaphragms with simultaneous vibration of the above 1st driving rod and 2nd driving rod.

But, in the conventional linear acoustic transducer, it was difficult for kinetic energy which was generated from the above driver to deliver efficiently into the above driving rod and diaphragms because biased connection of driving rod between driver and the center of diaphragms, and it has collision sound problem due to the collision between voice coil and yoke because it was occurred eccentricity at voice coil which is deployed between yoke and magnet, and in serious case, there was a problem that voice coil was damaged.

According to this situation, recently, it is presented that the above driving rod connects with driver and the center of diaphragms through biased deployment of driver and diaphragms. But, this conventional acoustic transducer had problems; it was difficult for acoustic transducer to be slim because of bigger diameter of housing due to the deployment two driving rods in a regular interval, to be complicated housing structure. Also, in the conventional acoustic transducer, there was output decreasing problem because two driving rods penetrate each diaphragm, causing leakage of acoustic pressure through penetrated hole at the above diaphragms when the air was pressured between the above diaphragms.

DETAIL DESCRIPTION OF THE INVENTION

Technical Issue

This invention is to solve those conventional technical problems. The main purpose of this invention is to provide linear acoustic transducer which delivers efficiently vibration energy of driver, through connection of driving rod with driver and the center of diaphragms.

Also, the other purpose of this invention is to provide linear acoustic transducer which generates acoustic signal by compression and expansion between the above diaphragms and partitions, when the diaphragms are vibrated by the above driving rod's vibration with regular intervals of partitions, which is deployed inside of the above housing, one or two driving rod is deployed in-line at the center of housing to minimize the diameter of housing.

Also, the other purpose of this invention is to provide linear acoustic transducer which minimizes the number of housing sections and simplifies assembly by laminated with a plurality of housing section. And, it is to provide the linear acoustic transducer; it has minimized acoustic pressure leakage by lubrication agent coating on the penetration hole which is deployed on the partitions.

Issue Solving Means

As a mean to achieve the purpose of the invention, linear acoustic transducer test case according to the invention is to have a feature to generate acoustic sound by the air compression and expansion between the above diaphragms and the above partitions, due to the vibration of the above driver and the above driver rod, including cylindrical shaped housing which has a plurality of open portion, driver which deployed in the one lower portion of the above housing and generates vibration according to the external electric signal, driving rod which deployed perpendicular at the inner center of housing and connected with the above driver, a plurality of diaphragms which fixed along the above driving rod in regular interval and fixed its edge into the above housing, a plurality of partitions which deployed at inner side of the above housing in integral body to close the gap among a plurality of diaphragms and formed penetration hole which the above driving rod penetrates.

Also, the other test case of linear acoustic transducer according to the invention is to have a feature which has a regular distance between the above 1st and 2nd rod's prior edges, deployed at the center of the above housing, including cylindrical shaped housing which has a plurality of open portion, 1st driver which deployed in the upper portion of the above housing and generate vibration according to the external electric signal, 2nd driver which deployed in the one lower portion of the above housing and generate vibration according to the external electric signal, 1st driving rod which deployed at the center of the above housing and connected into the above 1st driver, 2nd driving rod which deployed at the center of the above housing and connected into the above 2nd driver, a plurality of 1st diaphragms which fixed along the above 1st driving rod in regular interval and fixed its edge into the above housing, a plurality of 2nd diaphragms which fixed along the above 2nd driving rod in regular interval and fixed its edge into the above housing, a plurality of partitions which deployed at inner side of the above housing in integral body to close the gap among a plurality of 1st or 2nd diaphragms and formed penetration hole which the above 1st or 2nd driving rod penetrates.

Also, another test case of linear acoustic transducer according to the invention is 1st linear acoustic transducer consists of 1st cylindrical shaped housing which has a plurality of open portion, 1st driver which deployed in the upper portion of the above housing and generate vibration according to the external electric signal, 1st driving rod which deployed at the inside of the above housing and connected with the above 1st driver, a plurality of 1st diaphragms which fixed along the above 1st driving rod in regular interval and fixed its edge into the above 1st housing, 2nd cylindrical shaped housing which has a plurality of open portion and connected into the lower portion of 1st housing, a plurality of 1st partitions which deployed at inner side of the above housing in integral body to close the gap among a plurality of 1st diaphragms and formed penetration hole which the above 1st driving rod penetrates, And it includes 1st linear acoustic transducer consists of 2nd cylindrical shaped housing which has a plurality of open portion, 2nd driver which deployed in the lower portion of the above housing and generate vibration according to the external electric signal, 2nd driving rod which deployed at the inside of the above housing and connected with the above 2nd driver, a plurality of 2nd diaphragms which fixed along the above 2nd driving rod in regular interval and fixed its edge into the above housing, a plurality of 2nd partitions which deployed at inner side of the above 2nd housing to close the gap among a plurality of 2nd diaphragms and formed penetration hole which the above 2nd driving rod penetrates.

It has a feature which has a regular distance between the above 1st and 2nd rod's prior edges deployed at the center of the above 1st & 2nd housing, by coupling supplementary element between the above $1^{st}$ housing and 2nd housing.

More specifically, the above diaphragms or 1st diaphragms or 2nd diaphragms consist of center diaphragms at the center and edge diaphragms at the edge. The above center diaphragms have cone shape that the center is protruded downwards and the fixing hole is employed at the center to fix the above driving rod or the 1st driving rod or the above 2nd driving rod.

The above partitions or 1st partitions or 2nd partitions has cone shape that the center is protruded downwards and the fixing hole is employed at the center, which the above driving rod or the 1st driving rod or the above 2nd driving rod penetrates.

The above coupling supplementary element includes cylindrical shaped coupling section main body and $3^{rd}$ partitions which deployed at the center of inner side of the housing coupling section main body to close the above 1st & 2nd housing. The above 3rd partitions are deployed flatting.

The above partitions or the above 1st or 2nd partitions include yoke, magnet and the upper plate. The cylindrical bobbin which is wrapped by voice coil is deployed at air gap between the above yoke and magnet and damper is deployed at the outer circumference surface of the above damper.

The above housing or the above 1st or 2nd housing consists of diaphragms fixing portion to fix the above plurality of diaphragms or the above 1st or 2nd diaphragms, damper fixing portion to fix the above damper and driver fixing portion to fix the above driver or the above 1st or 2nd diver.

The above diaphragms fixing portion consists of laminated a plurality of diaphragms fixing section which has cylindrical shape, and diaphragms section main body which connected with the above diaphragms or $1^{st}$ or 2nd diaphragms at the upper portion, and deployed the above 1st or 2nd partitions in integral at the center portion.

The above diaphragms section main body is formed by a single step to fix the above diaphragms or 1st or 2nd diaphragms at the inner side of its upper portion, ring shaped protrusion portion which protrude upward at its upper outer portion, ring shaped cupping portion to correspond the above ring shaped protrusion portion at the lower circumference surface.

The above damper fixing portion consists one damper fixing section; the above damper fixing section has cylindrical shape, coupling plate which connect with the above driving rod or 1st or 2nd driving rod is deployed at the upper portion, damper section main body which is formed circular typed pressure ring to press the upper portion of the above damper located at the inner lower side, The above damper section main body is formed by a single step to fix the above coupling plate at the inner side of its upper portion, ring shaped protrusion portion which protrude upward at its outer upper portion, ring shaped cupping portion to correspond the above ring shaped protrusion portion at the lower circumference surface.

The above coupling plate is formed by coupling center diaphragms at the center, coupling edge diaphragms which deployed at the edge of the above coupling center diaphragms, fixing cupping which fixes the above drive or 1st or 2nd driving rod by insertion at the lower portion of the above coupling center diaphragms, coupling cupping which couples the above driving rod or 1st or 2nd driving rod at the lower center portion of coupling center diaphragms.

The above driver fixing portion is formed by a single driver fixing section; driver section main body has fixing cupping to fix the above driver or 1st or 2nd driver, circular shaped protrusion portion which has upward protruded at the inner upper portion, a single step to fix the edge of the inner damper at its inner upper portion, ring shaped cupping protrusion portion which has upward protruded at the outer upper portion.

Coupling wing is deployed perpendicular as an integral type at the above diaphragms section main body, damper section main body, and both circumference surface of driver section main body, and it is formed coupling cupping on the above coupling wing, fixing plate at the inner upper portion, fixing cupping to corresponding to the above fixing plate at the inner upper portion of the above coupling wing.

The above diaphragms main body, damper section main body, driver section main body and both circumference surface of the above coupling section main body has alignment hole which is penetrated longitudinally, and it is a feature of linear acoustic transducer for alignment pin to penetrate the above alignment hole when it is up-and-down coupled with the above diaphragms, damper section main body, the above driver section main body and the coupling section main body.

Effectiveness of the Invention

According to the invention of linear acoustic transducer, it enhances ability of acoustic generation by efficient delivery of driver's energy through driving rod connection to center of voice coil and diaphragms and is possible to prevent from collision sound between voice coil and magnet.

Also, the invention deploys a plurality of diaphragms in regular interval at driving rod which penetrate the inner center of housing, partitions in regular interval at the inside of the above housing. And it is able to generate acoustic signal by the air compression and expansion between the above diaphragms and the above partitions when the diaphragms are vibrated by the vibration of the driving rod.

Also, the invention minimizes the diameter of housing by deploying one or two driving rod which is formed inside of house in line at the center of housing, is possible to make slim housing by longitudinal section of housing intersection shape.

Also, the invention minimizes the number of sections by the partitions and modulation of housing into several housing sections, enhances assembly ability with the alignment hole at the sides of housing. And, the invention prevents acoustic pressure leakage by the closure between diaphragms with partitions, the coating of lubrication agent on the hole which deployed at partitions to penetrate driving rod.

FORMS OF INVENTION EMBODIMENT

Such as the below, preferred embodiment of linear acoustic transducer according the invention, refer to the attached drawing with detail description, is as follows.

Figure 1:
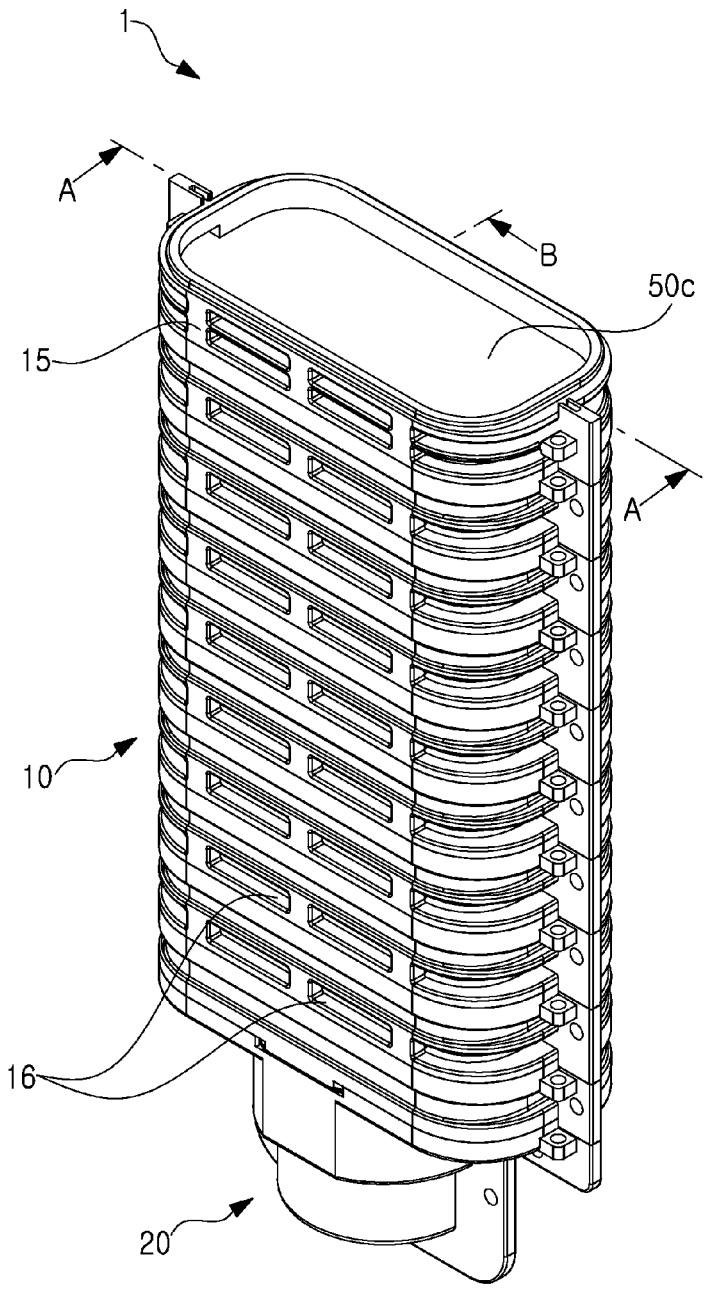
FIG. 1 is a perspective view of 1st embodiment example of linear acoustic transducer according to the present invention.
Figure 2:
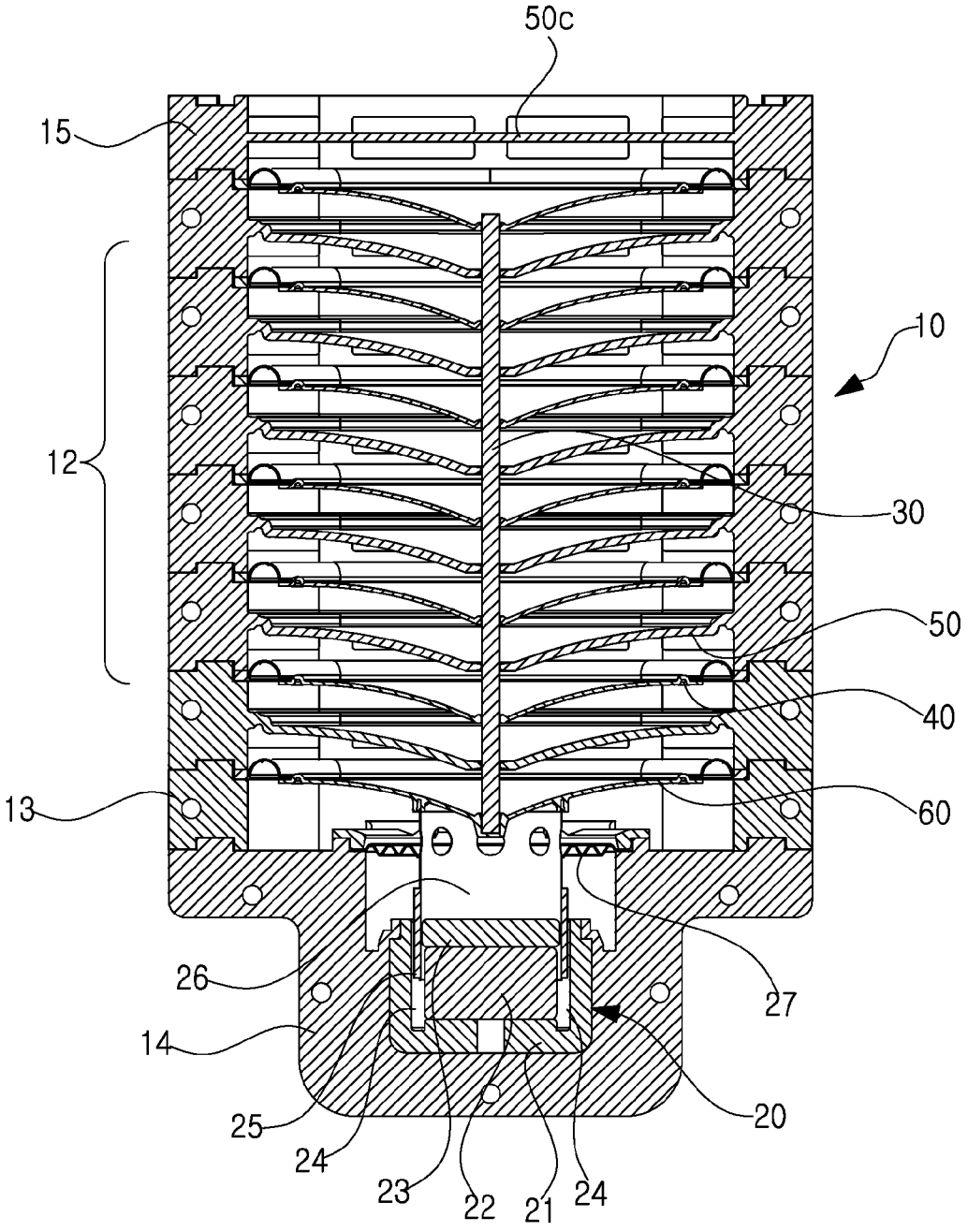
FIG. 2 is a cross-sectional diagram taken along line A-A of the linear acoustic transducer of FIG. 1.
Figure 3:
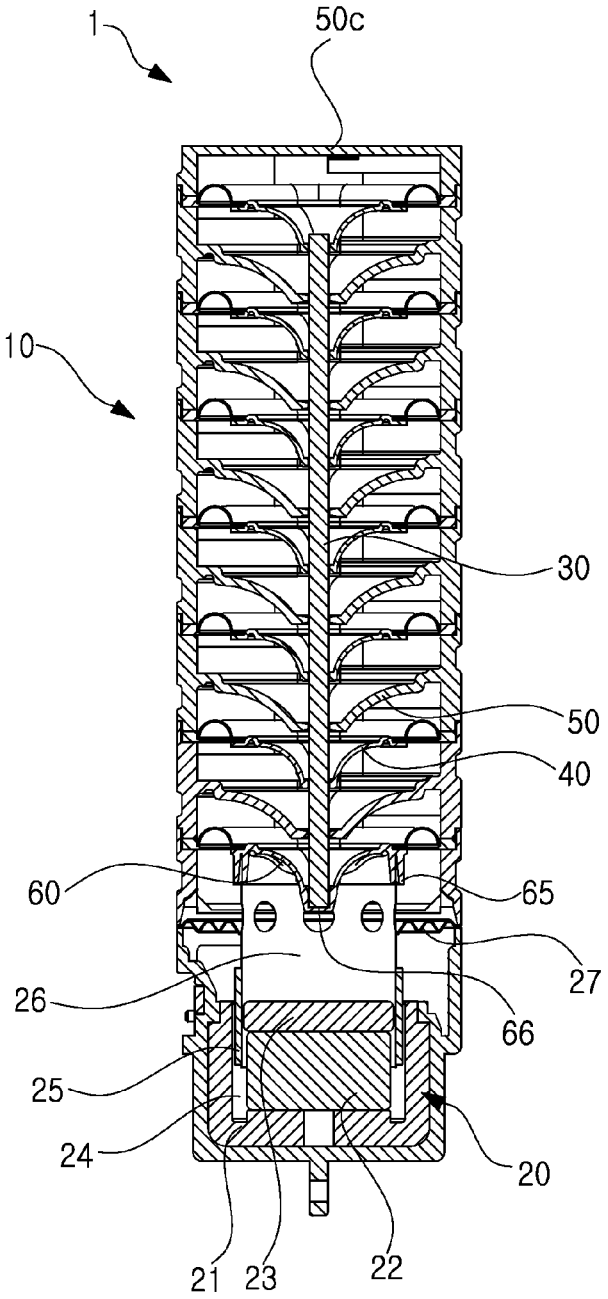
FIG. 3 is a cross-sectional diagram taken along line B-B of the linear acoustic transducer of FIG. 1.

FIG. 1 is a perspective view of 1st embodiment example of linear acoustic transducer according to the present invention, FIG. 2 is a cross-sectional diagram taken along line A-A of the linear acoustic transducer of FIG. 1 and FIG. 3 is a cross-sectional diagram taken along line B-B of the linear acoustic transducer of FIG. 1.

As illustrated, linear acoustic transducer (1) according to the invention is composed with cylindrical shaped housing (10) which has a plurality of open portion (16), driver (20) which deployed in the one lower portion of the above housing (10) and generate vibration according to the external electric signal, driving rod (30) which deployed perpendicular at the inner center of the above housing (10) and connected with the above driver (20), a plurality of diaphragms (40) which fixed along the above driving rod (30) in regular interval and fixed its edge into the above housing (10), a plurality of partitions (50) which deployed at inner side of the above housing (10) in integral body to close the gap among a plurality of diaphragms (40) and formed penetration hole (56) which the above driving rod (30) penetrate.

Thus, when the external electric signal is applied to the above driver (20), it causes up-and-down vibration of the above driver (20). When the above driver (20) vibrates up-and-down, the above driving rod (30) which is connected with the above driver (20) vibrates up-and-down. And, when the above driving rod (30) moves up-and-down, a plurality of diaphragms (40) which fixed along the above driving rod (30) moves together. And, when a plurality of diaphragms (40) moves up-and-down, it generates acoustic pressure due to the air compression or expansion between the above a plurality of diaphragms (40) and a plurality of partitions (50). This acoustic pressure generates acoustic sound due to the radiation through open portion (16) of the above housing (10).

On this wise, the 1st feature of this invention is to generate sufficient acoustic pressure through vibration of a plurality of diaphragms (40) with only one driving rod (30), i.e., the invention is formed of integral body with a plurality of partitions (50) to make sections and to close the neighboring diaphragms (40) at inside of the above housing (10). So, when a plurality of diaphragms (40) which fixed on the above driving rod (30) vibrates, it generates acoustic pressure due to the air compression or expansion between the above a plurality of diaphragms (40) and a plurality of partitions (50).

More specifically, the above driver (20) includes yoke (21), magnet (22) and the upper plate (23). And, voice coil (25) is deployed at air gap (24) between yoke (21) and magnet (22). And, the above voice coil (25) is wrapped on the circumference surface of cylindrical bobbin (26). Also, damper (27) is embodied on the circumference surface of the above bobbin (26). The above damper (27) acts a role to support the above bobbin (26) not to be trembled during the vibration.

Subsequently, the driving rod (30) is composed with pipe, circular shape of metal or plastic. The above driving rod (30) has similar length to the above housing (10), its one end is connected with bobbin (26) of the above driver (20) through the below coupling plate (60).

Figure 6:
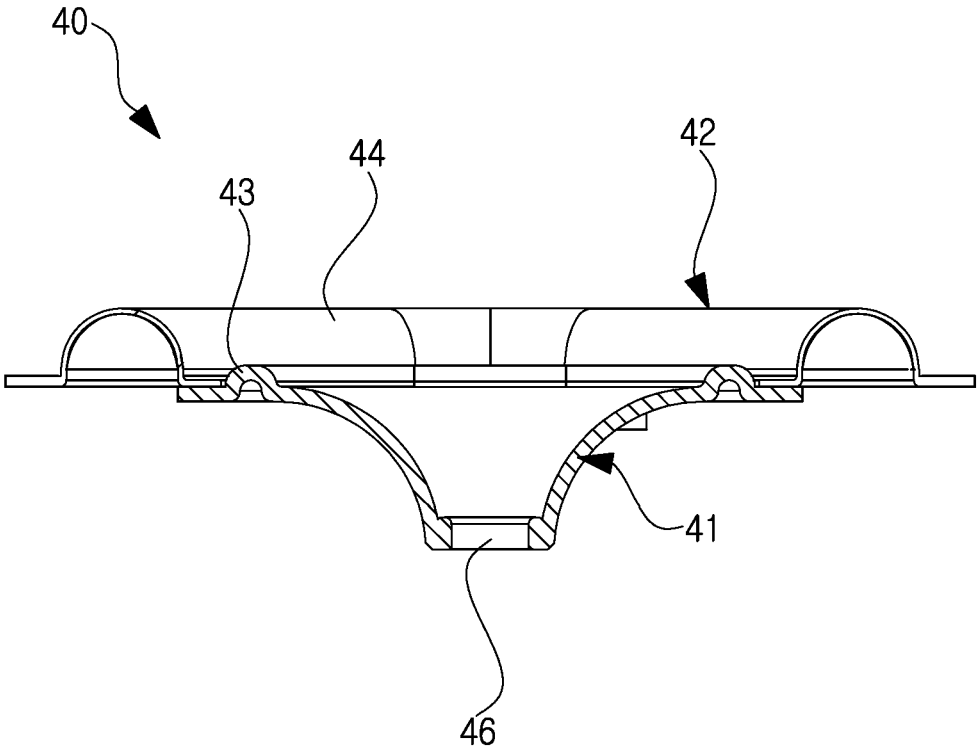
FIG. 6 is a cross-sectional diagram of diaphragms fixing portion according to the present invention.

The above diaphragms (40) are fixed in regular interval along the above driving rod (30). As shown in FIG. 6, the above diaphragms (40) are composed with the center diaphragms (41) and edge diaphragms (42) which are formed at the edge of the center diaphragms (41). The above center diaphragms (41) has cone shape that the center is protruded downwards and the fixing hole (46) is employed at the center to fix the above driving rod (30) through penetration. And, the dorm portion (44), protruded upward, is deployed at the center of the above edge diaphragms (42).

Figure 8:
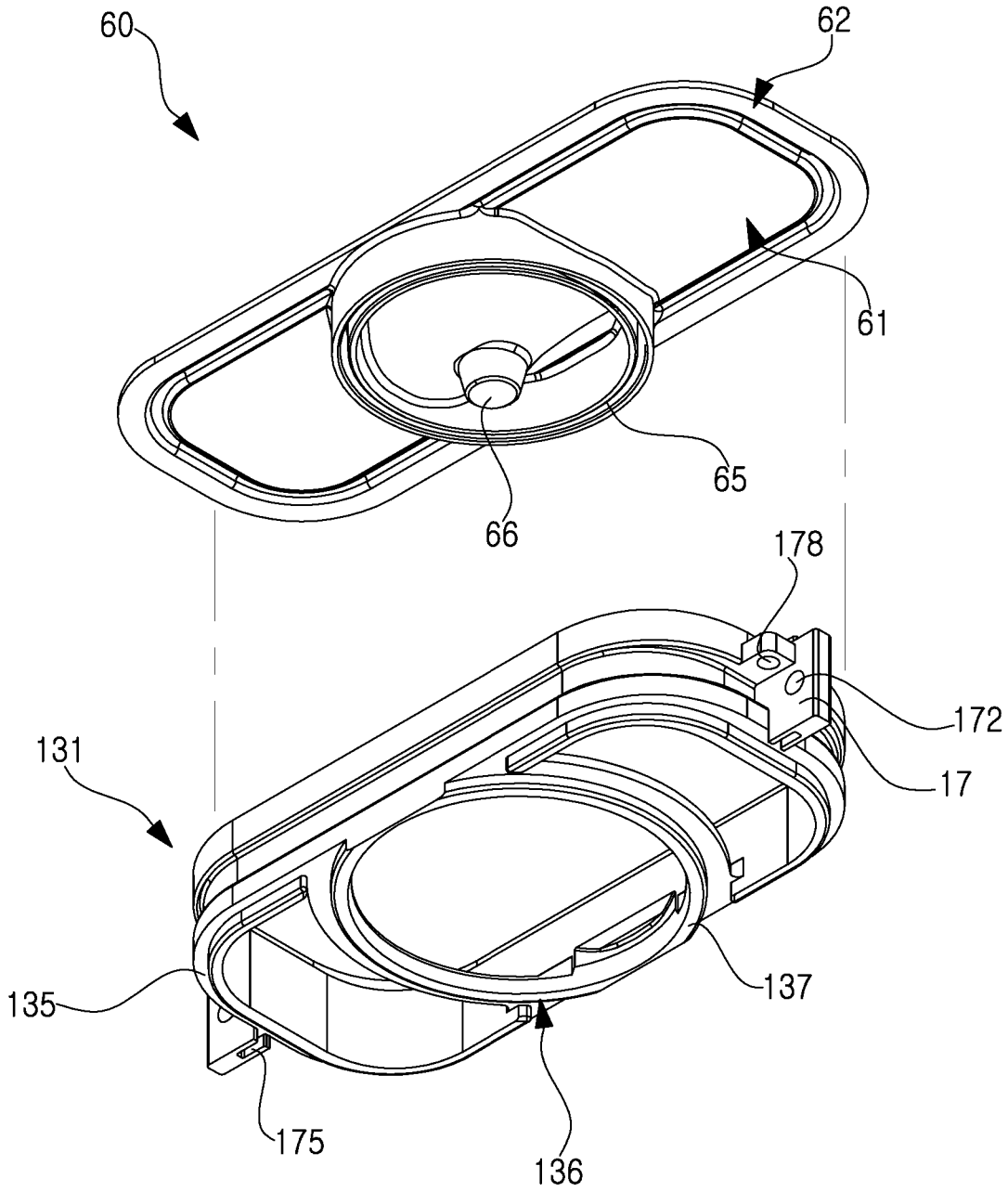
FIG. 8 is a disassemble perspective view of coupling plate according to the present invention.

The above coupling plate (60), as shown in FIG. 8, has similar structure to the above diaphragms (40), is composed with the center coupling plate (61) and edge coupling plate (62) which is formed at the edge of the center coupling plate (61). The upper side of the above center coupling plate (61) is fixed with the section portion of the above driving rod (30); the lower side of the above center coupling plate (61) is fixed with the upper section of the above bobbin (26). And, edge of the above edge coupling plate (62) is fixed at the above housing (10)

The fixing cupping (66) is embodied at the center of the above center coupling plate (61), to fix the sectional portion of the above driving rod (30) by insertion. The above fixing cupping (66) has the shape of protruded downward, is deployed a cupping at the upper plate to fix the sectional portion of the above driving rod (30) by insertion. And the ring shaped coupling cupping (65) is deployed at the lower plate of the above center coupling plate (61) to fix the upper section of the above bobbin (26) by insertion. The above coupling cupping (65) is formed in regular depth with ring shape which is inserted by the upper section of the above bobbin (26) at the center of ring shape bump which is prolonged downward in regular length.

Figure 4:
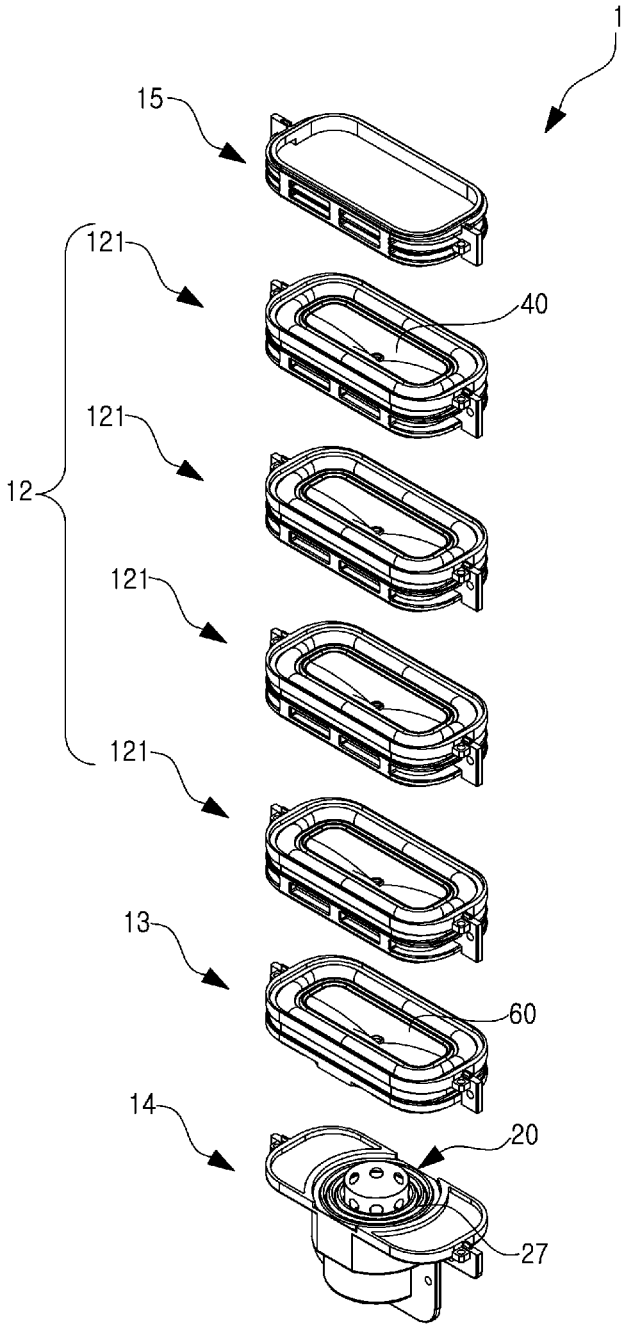
FIG. 4 is a disassemble perspective view of linear acoustic transducer of FIG. 1.

The above housing (10), as shown in FIG. 4, is composed with laminated a plurality of housing sections, i.e. The above housing (10) consists of diaphragms fixing portion (12) to fix the above plurality of diaphragms (40), damper fixing portion (13) to fix the above damper (27) and the above coupling plate (60), driver fixing portion (14) to fix the above driver (20), and coupling supplementary element (15) to close open portion of the above housing (10).

Figure 5:
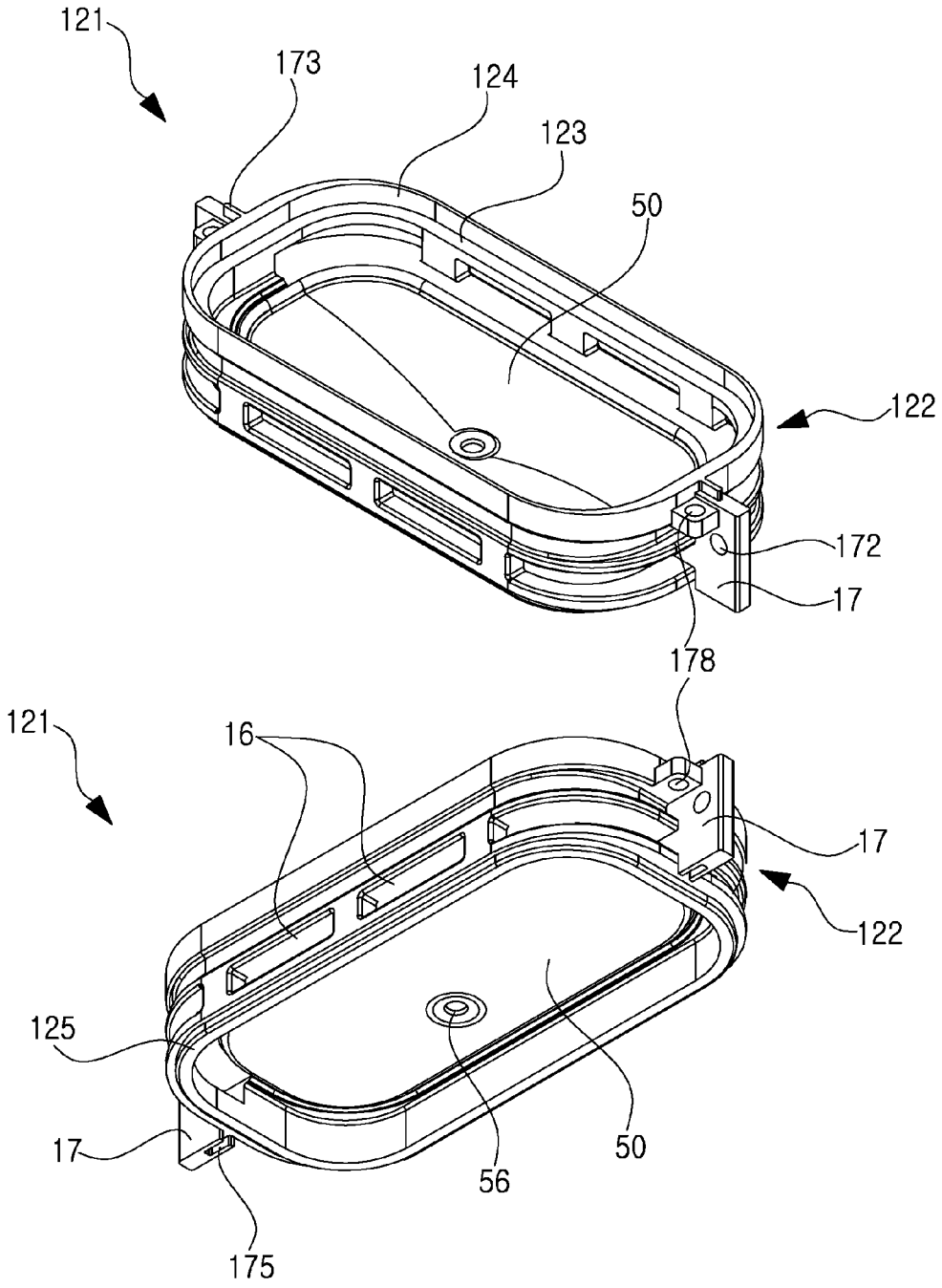
FIG. 5 is a perspective view of diaphragms fixing portion according to the present invention.

At first, the above diaphragms fixing portion (12), as shown in FIG. 4 and FIG. 5, is composed by the lamination of a plurality of diaphragms section (121). The number of above diaphragms section (121) is able to increase or decrease according to the size of housing (10).

Refer to FIG. 5, the above diaphragms section (121) is a cylindrical plastic mold, composed with diaphragms section main body (122) and partitions (50) which is deployed at the center of the above diaphragms section main body (122)

A single step (123) is deployed at the inner upper portion of the above diaphragms section main body (122). And the ring shaped protrusion portion (124) is deployed at outer upper portion of the above diaphragms section main body (122). And the ring shaped cupping portion (125) is deployed corresponding to the above ring shaped protrusion portion (124) at the lower circumference surface of the above diaphragms section main body (122). Thus, if two diaphragms section main bodies (122) are coupled above and below, the above ring shaped protrusion portion (124) and the above ring shaped cupping portion (125) are coupled and fixed.

The Coupling wing (17) is deployed perpendicular as an integral type at the above diaphragms section main body (122). The coupling cupping (172) is deployed on the above coupling wing (17). Also, and it is formed coupling cupping (175) on the above coupling wing (17), the above fixing plate (173) at the inner upper portion, the above fixing cupping (175) to corresponding to the above fixing plate (173) at the inner upper portion of the above coupling wing (17). Thus, if two diaphragms section main bodies (122) are coupled above and below, the above fixing plate (173) and the above coupling cupping (172) are coupled and fixed. Also, the alignment hole (178) is deployed, penetrated up-and-down, at one side of the above coupling wing (17). The above alignment hole (178) is deployed in horizontal prolonged from the one side of the above coupling wing (17); the above alignment hole (178) is used for assembly of housing (10).

The above partitions (50) are composed at inner center of the above diaphragms section main body (122). This is cone shape that the center is protruded downwards. This has a similar size and shape with the cone in the above diaphragms (40). And, the penetration hole (56), penetrates by the above driving rod (30), is deployed at the center of the above partitions (50). The above penetration hole (56) has a bigger diameter than the above driving rod (30). And, lubrication agent like grease is coated at the above penetration hole (56). This lubrication agent makes the driving rod (30) to move free up-and-down, simultaneously, prevents acoustic pressure leakage by the closure for the above penetration hole (56).

Thus, if the diaphragms (40) is deployed at the upper portion of the above diaphragms section main body (122), and a plurality of diaphragms section (121) is laminated upward-and-downward, the diaphragms is fixed between pluralities of diaphragms section (121). And, the partitions (50) are located between neighboring diaphragms (40) to close the gap between the diaphragms (40). Thus, if diaphragms (40) is embodied between laminated pluralities of diaphragms sections (121) and coupled, it is diaphragms coupling portion (12) which embodied a plurality of diaphragms (40).

Figure 7:
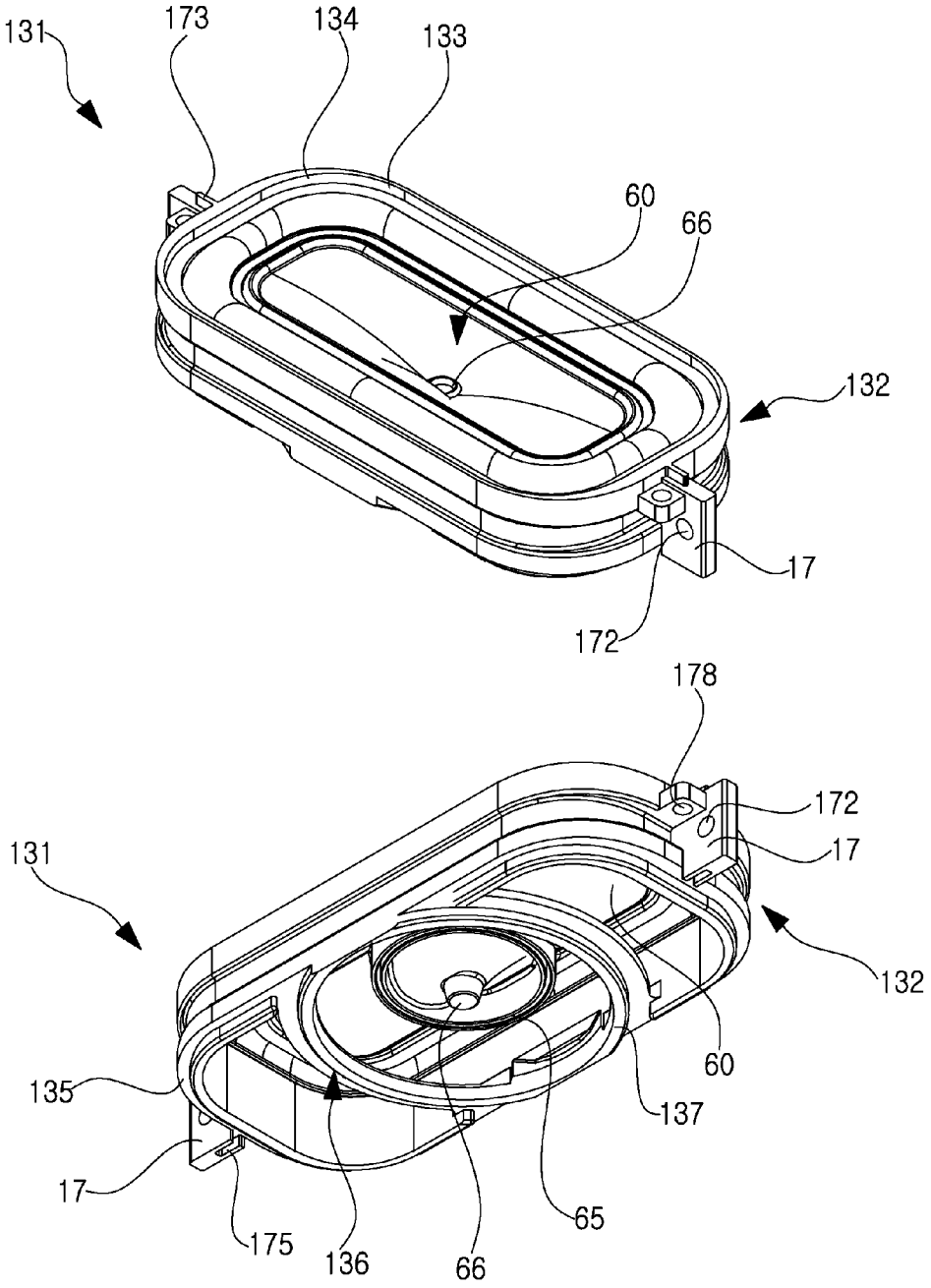
FIG. 7 is a perspective view of damper fixing portion according to the present invention.

Subsequently, the above damper fixing portion (13), shown in FIG. 4 and FIG. 7, is deployed between the above diaphragms fixing portion (12) and driver fixing portion (14). The above damper fixing portion (13) is to fix the above damper (27) and the above coupling plate (60), formed the damper section main body (132) which is cylindrical plastic mold. The pressure ring (136) is deployed integral at the inner lower portion of the above damper section main body (132), to give the pressure on the upper side of the above damper (27).

Refer to FIG. 7, the single step (133) is deployed to fix the above coupling plate (60) at the inner side of the above damper section main body (132). And, the ring shaped protrusion portion (134) which protrude upward at outer upper portion at the above damper section main body (131). And, the ring shaped cupping portion (135) corresponding to the above ring shaped protrusion portion (134) at the lower circumference surface of the above damper section main body (131). Thus, if the above damper section main body (132) is coupled to the lower portion of diaphragms section main body (122), the ring shaped protrusion portion (134) and the ring shaped cupping portion (125) of diaphragms section main body (122) are coupled and fixed. Also, if the below driver section (141) of the above damper section main body (132) is coupled, the above ring shaped cupping portion (135) is coupled with ring shaped protrude portion (144) of the above driver section (141). Also, the pressure protrude portion (137) is more embodied at the inner lower portion of the above pressure ring (136) to press the upper side of the above damper (27).

The coupling wing (17) is deployed longitudinally, as an integral type at the both side of circumference surface of the above damper section main body (131). And, the coupling cupping (172) is deployed at the above coupling wing (17). The above coupling cupping (172) is used to fix with prescribed coupling method. Also, the fixing plate (173) is protruded formed at the inner upper portion of the coupling wing (17), and the fixing cupping (175), inserting the above fixing plate (173), is deployed at the inner lower portion of the above wing (17). Also, the alignment hole (178), penetrating upward-and-downward, is embodied at the one side of the above coupling wing (17).

Thus, when the coupling plate (60) is set to the a single step (133) on the upper side of the above damper fixing section (131) and coupled to the lower portion of the above diaphragms fixing portion (12). And, if the above driver fixing portion (14) is fixed to the lower portion of the above damper fixing section (131), the damper (27) is fixed between the above damper fixing section (131) and, the above driver fixing portion (14). At this time, the upper portion of the bobbin (26) in the above driver (20) is inserted into fixing cupping (56) of the coupling plate (50) and fixed.

Figure 9:
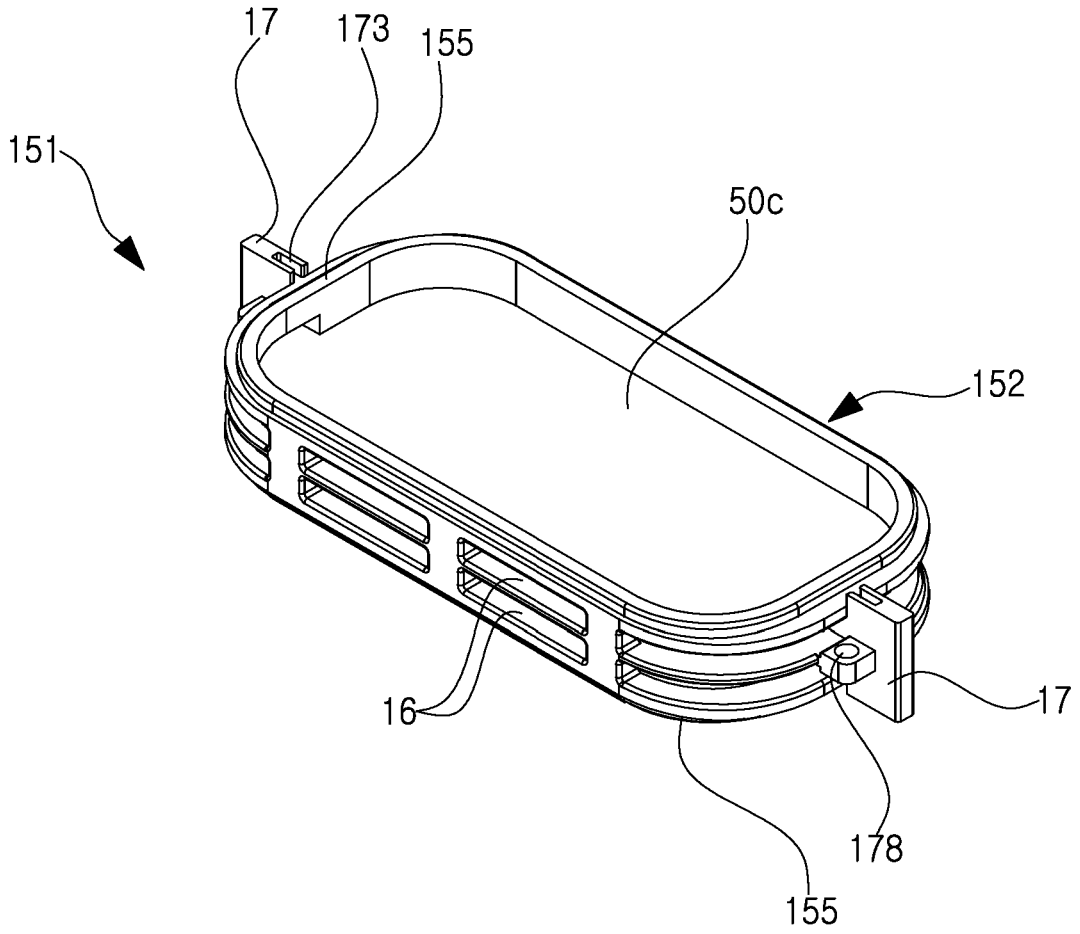
FIG. 9 is a perspective view & a cross-sectional diagram of driver fixing portion according to the present invention.

Subsequently, The above driver fixing portion (14), as shown in FIG. 4 and FIG. 9, is formed by a single driver fixing section (14), the driver fixing section (141) is fixed to the lower portion of the above damper fixing portion (13), formed with plastic mold which embodied settle cupping (143) to set cylindrical yoke (21) at center.

Refer to FIG. 9, a single step (147) is formed to set for the edge of the damper (27) at the inner upper side of the above driver section main body (142). The above a single step (147) consists of circular ring with a regular height on the driver section main body (142). And, ring shaped protrusion portion (144) which protrude upward is formed to correspond ring shape cupping portion (135) of the above damper fixing section (131) at the upper outer portion of the above driver section main body (142).

Also, the Coupling wing (17) is deployed as an integral type at the both circumference surface of driver section main body (142), and coupling cupping (172) is deployed on the Coupling wing (17). And, the fixing plate (173) is embodied at the inner upper portion of the above Coupling wing (17). And, the alignment hole (178) is more embodied, penetrated up-and-down, at one side of the above coupling wing (17).

Thus, cylindrical yoke (21) is installed at the settle cupping (143) of the above driver section main body (142), cylindrical magnet (22) is installed at the inside of the above yoke (21). And, cylindrical bobbin (26) is installed to be located at air gap (24) between the above yoke (21) and the above magnet (22). At this moment, voice coil (25) is wrapped on the circumference surface of the above bobbin (26) and, damper (27) is installed at outer side of the circumference surface of the above bobbin (26). The above damper (27) is formed in shape of circular plate, with penetration portion that the above bobbin (26) penetrates.

And, if the above driver fixing section (141) is coupled to the lower portion of the damper fixing section (131), the pressure ring (136) of the above damper fixing section (131) press the edge of damper (27) to fix. And, the upper portion of the above bobbin (26) is inserted into the coupling cupping (65) which is embodied the lower portion of coupling plate (60) at damper fixing section (131) and fixed.

Figure 10:
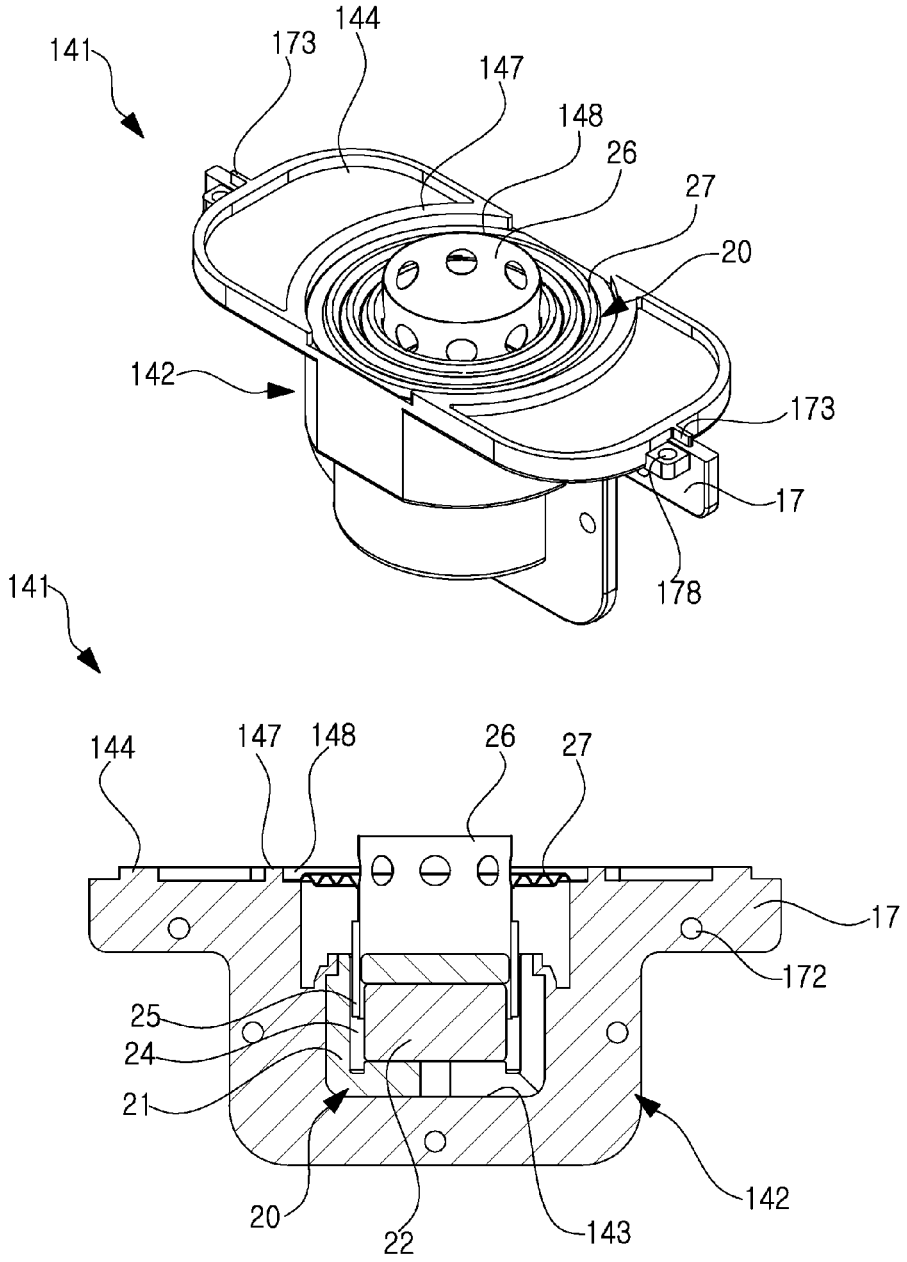
FIG. 10 is a perspective view of coupling supplementary element according to the present invention.

Finally, the above coupling supplementary element, as shown in FIG. 4 and FIG. 10, consists of the coupling section (151). The above coupling section (151), is a plastic mold, consists of coupling section, 3rd partitions (50C) which is formed at the center of inside of the above coupling section main body (152). The above $3^{rd}$ partitions (50*c*) are composed in shaped of plate. The above 3rd partitions (50*c*) are embodied at the end portion of the above housing (10), to close the open portion.

The ring shaped cupping portion (155) is formed corresponding to each ring shaped protrusion portion (124) of the above diaphragms section main body (121) at the outer lower portion of the coupling section main body (152). And, coupling wing (17) is formed integral at both side circumference surface of the above coupling section main body (152), the coupling cupping (172) is possible to be formed at the above coupling wing (17). And, the fixing plate (173) is employed at the inner upper portion of the above coupling wing (17), the fixing cupping (175) is formed corresponding to the fixing plate (173) at the inner upper and lower portion of the coupling wing (17). Also, the alignment hole (178) is more embodied, penetrated up and-down, at one side of the above coupling wing (17).

On this wise, as shown in FIG. 4, housing (10) is completed if the above diaphragms fixing portion (12), damper fixing portion (13), driver fixing portion (14) and coupling supplementary element (15) are assembled in order. Subsequently, a driving rod (30) is embodied at inside of the above housing (10). The above driving rod (30) is embodied perpendicular at the center of the above housing (10), penetrating fixing hole (46) of diaphragms (40) and penetration hole (56) of partitions (50). And, short portion of the driving rod (30) is inserted into the fixing cupping (66) of the above coupling plate (60) and fixed. At this moment, adhesive agent is coated at the fixing hole (46) of the above diaphragms (40), lubrication agent as grease is coated at the penetration hole (56) of the above partitions (50). Then, the above diaphragms (40) is fixed to driving rod (30), the above driving rod (30) is penetrating the penetration hole (56) of the above partitions (50).

Thus, according to the invention, it enhances ability of acoustic generation by efficient delivery of the above driver's (20) energy through the above driving rod (30) connection to center of driver (20) and diaphragms (30) and is possible to prevent from collision sound between voice coil and magnet.

Also, the invention deploys a plurality of diaphragms (40) in regular interval at one driving rod (30) which penetrates the inner center of housing (10), and deploys partitions (50) in regular interval at the inside of the above housing (10). And it is able to generate acoustic signal by the air compression and expansion between the above diaphragms (40) and the above partitions (50) when the above diaphragms (40) are vibrated by the driving rod's vibration (30)

Also, the invention minimizes the diameter of housing (10) by deploying driving rod (30) which is formed perpendicular at the inner center of housing (10), is possible to make slim housing (10) by the minimum number of section through several sections and modules of housing and it results in easy assembly and can save the expenses.

Also, the invention divides neighboring diaphragms (40) with partitions (50) into sections and close sections. And, it is possible to prevent acoustic pressure leakage by the closure between the above diaphragms (40) and the above partitions (50), by the coating of lubrication agent on the penetration hole (56) which deployed at the above partitions (50) for penetration of the above driving rod (30).

Figure 11:
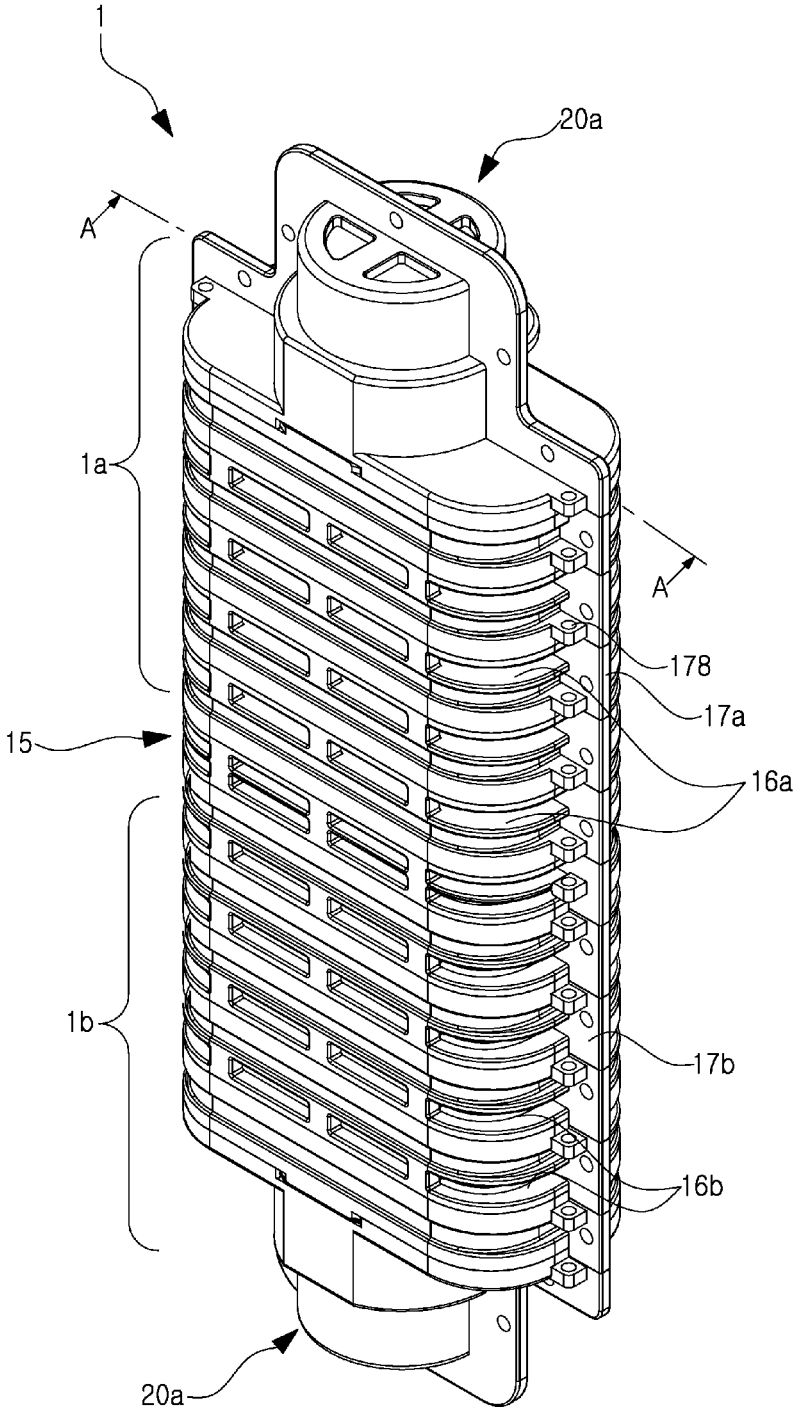
FIG. 11 is a perspective view of alternative embodiment example of linear acoustic transducer according to the present invention.
Figure 12:
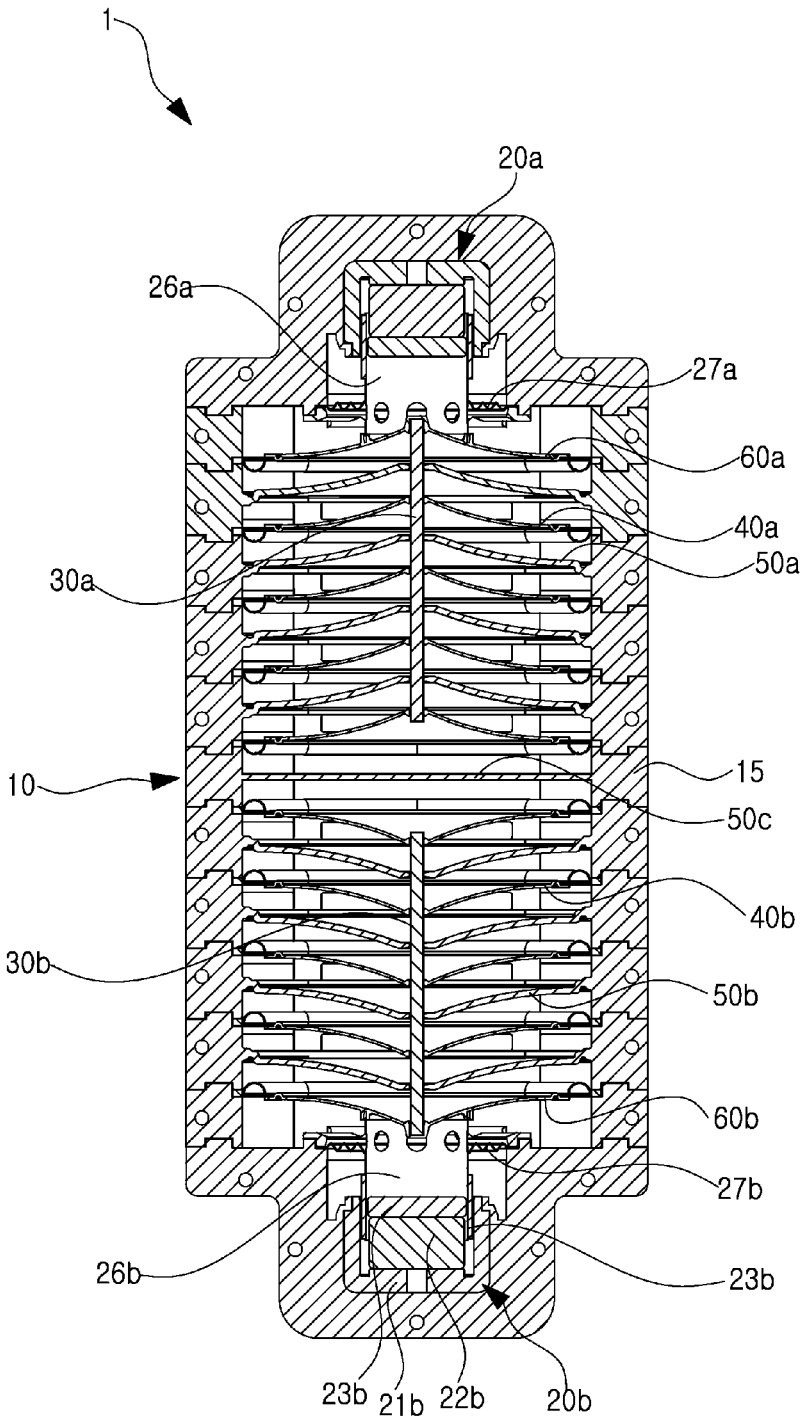
FIG. 12 is a cross-sectional diagram of the linear acoustic transducer which is illustrated in FIG. 11.
Figure 13:
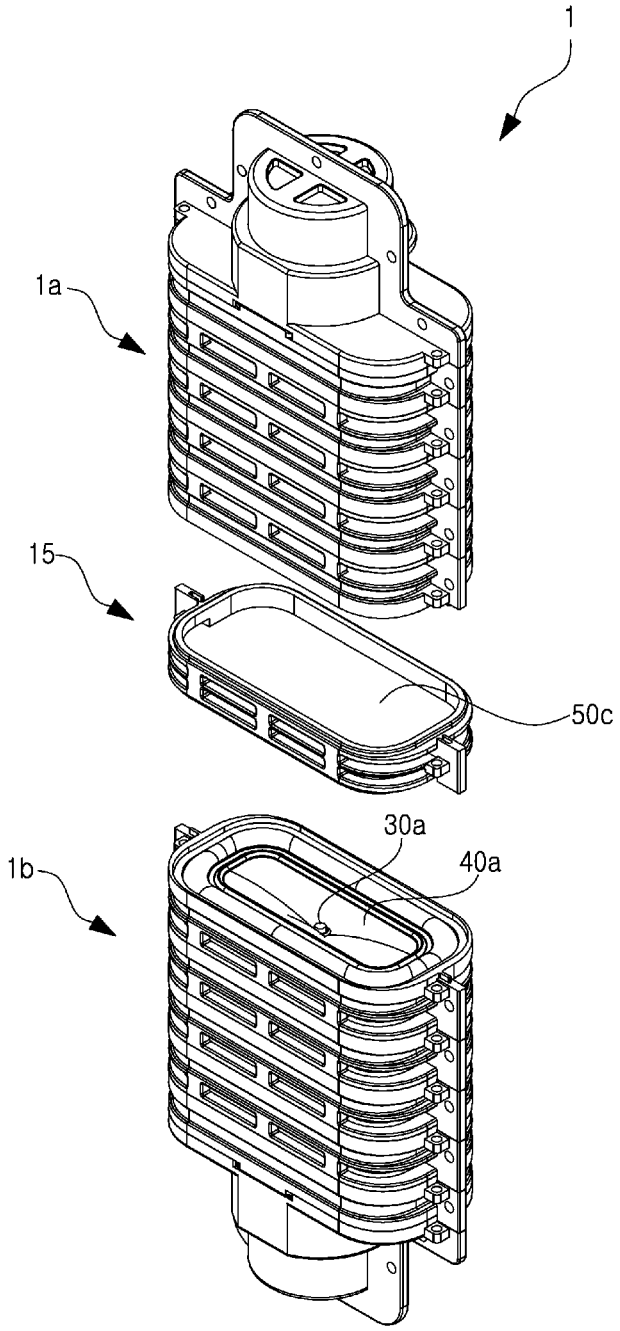
FIG. 13 is a disassemble perspective view of linear acoustic transducer which is illustrated in FIG. 11.

Subsequently, FIG. 11 is a perspective view of 2nd embodiment example of linear acoustic transducer according to the present invention, FIG. 12 is cross-sectional diagram of the linear acoustic transducer of FIG. 10, FIG. 13 is a disassemble perspective view of linear acoustic transducer of FIG. 10.

As illustrated, the linear acoustic transducer (1) according to this embodiment, includes 1st linear acoustic transducer (1*a*) which is composed with 1st housing (10*a*) which has cylindrical shaped and longitudinal a plurality of open portion (16*a*), 1st driver (20*a*) which deployed in the upper portion of the above 1st housing (10*a*) and generate vibration according to the external electric signal, 1st driving rod (30*a*) which deployed perpendicular at the center of the above 1st housing (10*a*) and connected into the above 1st driver (20*a*), a plurality of 1st diaphragms (40*a*) which fixed along the above 1st driving rod (30*a*) in regular interval and fixed its edge into the above 1st housing (10*a*), a plurality of 1st partitions (50*a*) which deployed at inner side of the above 1st housing (10*a*) in integral body to close the gap among the above plurality of 1st diaphragms (40*a*) and formed the penetration hole (56*a*) which the above 1st driving rod (30*a*) penetrate, 2nd linear acoustic transducer (1*a*) which is composed with cylindrical 2nd housing (10*b*) which has 1 longitudinal a plurality of open portion (16*a*) and is connected to the lower portion of the above $1^{st}$ housing (10*a*), 2nd driver (20*b*) which deployed in the upper portion of the above 2nd housing (10*b*) and generate vibration according to the external electric signal, 2nd driving rod (30*b*) which deployed perpendicular at the center of the above 2nd housing (10*b*) and connected into the above 2nd driver (20*b*), a plurality of 2nd diaphragms (40*b*) which fixed along the above 2nd driving rod (30*b*) in regular interval and fixed its edge into the above 2nd housing (10*b*), a plurality of 2nd partitions (50*b*) which deployed at inner side of the above 2nd housing (10*b*) in integral body to close the gap among neighboring the above plurality of 2nd diaphragms (40*b*) and formed the penetration hole (56*a*) which the above 2nd driving rod (30*b*) penetrates. And, it is composed including the coupling supplementary element (15) to combine the lower portion of the above 1st housing (10*a*) and the upper portion of the above 2nd housing (10*b*) between the above 1st linear acoustic transducer (1*a*) and the above 2nd linear acoustic transducer (1*b*).

And, the 1st and 2nd driving rod (30*a*) (30*b*) are perpendicular embodied inside of the above 1st and $2^{nd}$ housing (10*a*) (10*b*). The above 1st and 2nd driving rod (30*a*) (30*b*) are arrayed in-line at the center of the above 1st and 2nd Housing (10*a*) (10*b*). And, the tip of the above 1st driving rod (30*a*) and the above $2^{nd}$ driving rod (30*b*) are embodied facing each other in regular distance.

Thus, this embodiment of the linear acoustic transducer (1) has the feature which has the much higher output with longitudinal connection of two linear acoustic transducers (1*a*) (1*b*). The specific composition of the above linear acoustic transducers (1*a*) (1*b*) are as above-mentioned embodiment.

I.e., the above 1st and 2nd drivers (20*a*) (20*b*) includes the yoke (21), the magnet (22) and the upper plate (23). And, the voice coil (25) is deployed at air gap between the above yoke (21) and magnet (22). The above voice coil (25) is wrapped on the circumference surface of the cylindrical bobbin (26). Also, the damper (27) is deployed at the outer circumference surface of the above bobbin (26).

Subsequently, the above 1st and 2nd driving rod (30*a*) (30*b*) are composed with pipe or cylinder of metal or plastic. The above driving rod (30) has similar length to the above housing (10), its one end is connected with bobbin (26) of the above driver (20) through the below coupling plate (60).

The above diaphragms (40) are fixed in regular interval along the above driving rod (30). As shown in FIG. 6, the above diaphragms (40) are composed with the center diaphragms (41) and edge diaphragms (42) which are formed at the edge of the center diaphragms (41). The above center diaphragms (41) have cone shape that the center is protruded downwards. And the fixing hole (46) is employed at the center of the above center diaphragms (41) to fix the above driving rod (30) through penetration. And, the dorm portion (44), protruded upward, is deployed at the center of the above edge diaphragms (42).

The above 1st and 2nd coupling plates (60*a*)(60*b*), as shown in FIG. 8, have similar structure to the above diaphragms (40), is composed with the center coupling plate (61) and edge coupling plate (62) which is formed at the edge of the center coupling plate (61). The upper side of the above center coupling plate (61) is fixed with the section portion of the above driving rod (30); the lower side of the above center coupling plate (61) is fixed with the upper section of the above bobbin (26). And, edge of the above edge coupling plate (62) is fixed at the above housing (10)

The above 1st and 2nd housings (10*a*)(10*b*), as shown in FIG. 4, are composed with laminated a plurality of housing sections, i.e., The above housing (10) consists of diaphragms fixing portion (12) to fix the above plurality of diaphragms (40), damper fixing portion (13) to fix the above damper (27) and the above coupling plate (60), driver fixing portion (14) to fix the above driver (20), and coupling supplementary element (15) to close open portion of the above housing (10).

Specifically, the above diaphragms fixing portion (12), as shown in FIG. 5, is composed by the lamination of a plurality of diaphragms section (121). And, the above diaphragms section (121) is a cylindrical plastic mold, composed with diaphragms section main body (122) and partitions (50) which is deployed at the center of the above diaphragms section main body (122)

The above 1st and 2nd partitions (50*a*) (50*b*) are composed integral at inner center of the above diaphragms section main body (122). The above partitions are composed of cone shape that the center portion is protruded downwards. And, the penetration hole (56), penetrates by the above driving rod (30), is deployed at the center of the above partitions (50). The above penetration hole (56) has a bigger diameter than the above driving rod (30).

The above damper fixing portion (13), shown in FIG. 7, is deployed between the above diaphragms fixing portion (12) and driver fixing portion (14). The above damper fixing portion (13) is to fix the above damper (27) and the above coupling plate (60), formed the damper section main body (132) which is cylindrical plastic mold. The pressure ring (136) is deployed integral at the inner lower portion of the above damper section main body (132), to give the pressure on the upper side of the above damper (27).

The above coupling supplementary element (15), as shown in FIG. 10, consists of the coupling section (151). The above coupling section (151), is a plastic mold, consists of coupling section, 3rd partitions (50C) which is formed at the center of inside of the above coupling section main body (152). The above 3rd partitions (50*c*) are composed in shaped of plate. The above 3rd partitions (50*c*) are embodied at the end portion of the above 1st and 2nd housings (10*a*) (10*b*), to close the short portion.

The ring shaped cupping portion (155) is formed corresponding to each ring shaped protrusion portion (124) of the above diaphragms coupling section (12) at the outer side portion and inner lower portion of the coupling section main body (152). And, coupling wing (17) is formed integral at both side circumference surface of the above coupling section main body (152), the coupling cupping (172) is possible to be formed at the above coupling wing (17). And, the fixing plate (173) is employed at the inner upper portion of the above coupling wing (17), the fixing cupping (175) is formed corresponding to the fixing plate (173) at the inner upper and lower portion of the coupling wing (17). Also, the alignment hole (178) is more embodied, penetrated perpendicular up-and-down, at one side of the above coupling wing (17).

Thus, if the 1st housing (10*a*) is coupled to the upper tip of the above coupling section (151) and the $2^{nd}$ housing (10*b*) is coupled to the upper tip of the above coupling section (151), the ring shaped protrusion portion (124) is coupled to the above protrusion portion (124) of the above 1st and 2nd diaphragms coupling portion (12*a*) (12*b*). And, the fixing plate (173) of the above 1st and 2nd diaphragms (173) is coupled by insertion to the coupling cupping (175) of the above 1st and 2nd diaphragms coupling portion (12*a*) (12*b*). If so, the 1st & 2nd housings (10*a*) (10*b*) are coupled integral with coupling supplementary element (15) as the center.

specifically, the above 1st and 2nd driving rod (30*a*) (30*b*) are embodied in a straight line at the center of the 1st and 2nd housings (10*a*) (10*b*). And, the tip of the above 1st driving rod (30*a*) and the 2nd driving rod (30*b*) are in regular distance. And the 1st and 2nd partitions (50*a*) (50*b*) are embodied between the above 1st and 2nd diaphragms (40*a*) (40*b*). The above 1st and 2nd partitions (50*a*) (50*b*) is located between the 1st and $2^{nd}$ partitions (50*a*) (50*b*), to make a section and close it. And the above 1st and 2nd driving rod (30*a*) (30*b*) are embodied through the penetration hole (56) at the 1st and 2nd partitions (50*a*) (50*b*), and lubricant agent is coated at the above penetration hole (56) to move the above 1st and 2nd driving rod (30*a*) (30*b*) upward and-downward Thus, if the external electric signal is applied to the above 1st driver (20*a*), it causes up-and-down vibration of the above 1st driver (20*a*). When the above 1st driver (20*a*) vibrates up-and-down, the above 1st driving rod (30*a*) which is connected with the above 1st driver (20*a*) vibrates up-and-down. And, when the above driving rod (30*a*) moves up-and-down, the above 1st plurality of diaphragms (40*a*) which fixed at the above 1st driving rod (30*a*) moves up-and-down together, and it generates acoustic pressure due to the air compression or expansion between the above a plurality of diaphragms (40*a*) and a plurality of partitions (50*a*). This acoustic pressure generates acoustic sound due to the radiation through the 1st open portion (16*a*) of the above 1st housing (10*a*). Also, if the external electric signal is applied to the above 2nd driver (20*b*), it causes up-and-down vibration of the above 2nd driver (20*b*). When the above 2nd driver (20*b*) vibrates up-and-down, the above 2nd driving rod (30*b*) which is connected with the above 2nd driver (20*b*) vibrates up-and-down. And, when the above 2nd driving rod (30*b*) moves up-and-down, the above $2^{nd}$ plurality of diaphragms (40*a*) which fixed at the above 2nd driving rod (30*b*) moves up-and-down together, and it generates acoustic pressure due to the air compression or expansion between the above 2nd plurality of diaphragms (40*b*) and the above 2nd plurality of partitions (50*b*). This acoustic pressure generates acoustic sound due to the radiation through the 2nd open portion (16*b*) of the above 2nd housing (10*b*).

Thus, the linear acoustic transducer (1) according to this embodiment is able to transfer the vibration energy of the above 1st and 2nd driver (20*a*) (20*b*) because the above 1st and 2nd driving rod (30*a*) (30*b*) are connected with the center of the 1st and 2nd diaphragms (40*a*) (40*b*) and the 1st and 2nd drivers (20*a*) (20*b*).

Figure 14:
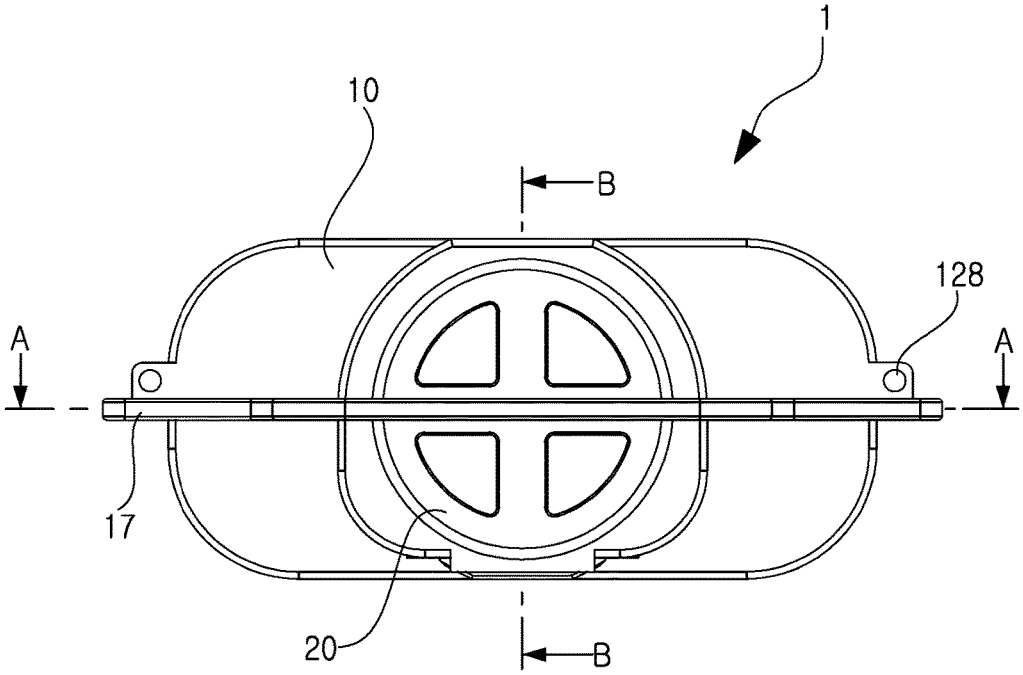
FIG. 14 is a plan view of sectional shape of housing according to the present invention.

Also, the invention is able to minimize of the diameter of the above housings (10*a*) (10*b*) because the above 1st and 2nd driving rod (30*a*) (30*b*) are embodied in a straight line at the center of inside the above housings (10*a*) (10*b*). Also, as shown in FIG. 14, it is able to make housings (10*a*) (10*b*) to be slim due to rectangle sectional shape of the above housings (10*a*) (10*b*).

Figure 15:
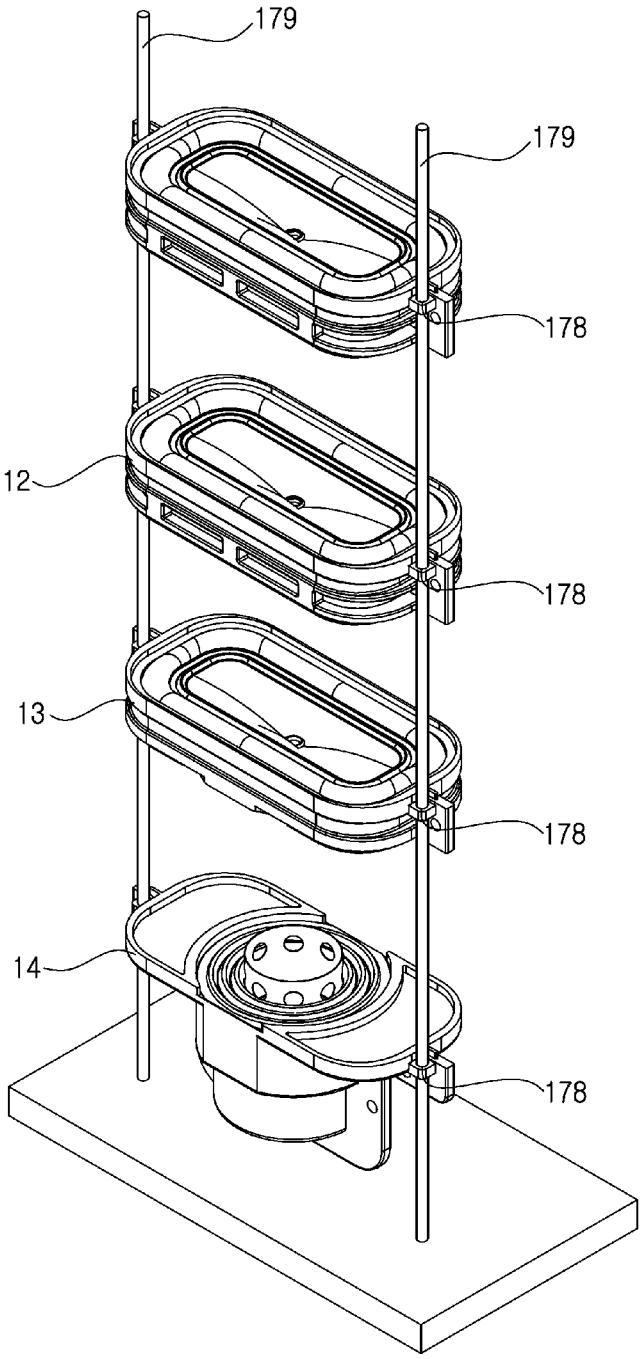
FIG. 15 is a diagram illustrating the assembly method of housing according to the present invention.
Figure 16:
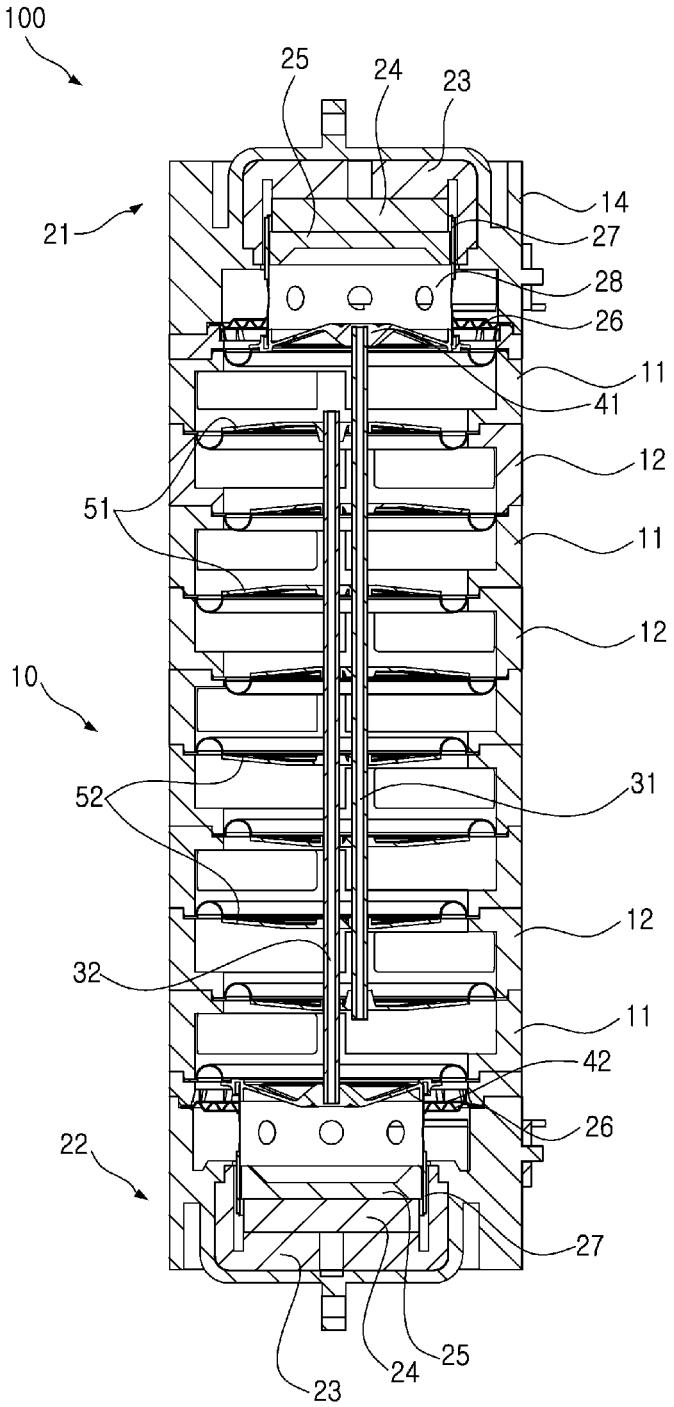
FIG. 16 is a rough cross-sectional diagram of linear acoustic transducer according to the conventional technology.

Meanwhile, FIG. 15 is a diagram illustrating the assembly method of housing (10) according to the present invention. As illustrated, the above housing (10) is composed laminated of a plurality of diaphragms fixing section (121), the damper coupling section (131), the driver coupling section (141) and the coupling section (151). Thus, when it is assembled the above housing (10), it is required to align precisely the above diaphragms coupling section (121), the damper coupling section (131), the driver coupling section (141) and the coupling section (151).

As described above, the alignment cupping (178) is deployed at both side of the above diaphragms coupling section (121), the damper coupling section (131), the driver coupling section (141) and the coupling section (151). Thus, when the housing (10) is assembled by lamination upward-and-downward with these parts, it is able to assemble easily for the above housing (10) that two alignment pin (179), embodied parallel in regular distance, penetrates the above alignment hole (178), i.e. when it is sequent assemble coupling section (121), the damper coupling section (131), the driver coupling section (141) and the coupling section (151), if it is assembled that two alignment pins (179) penetrates the alignment hole (178) of the above diaphragms coupling section (121), the damper coupling section (131), the driver coupling section (141) and the coupling section (151), it is possible to assemble of the housing (10) easily and to prevent the defective.

And, in this specification, it describes that the coupling supplementary element (15) is embodied between the 1st and 2nd housings (10*a*) (10*b*) and two linear acoustic transducers (1*a*) (1*b*) is connected in serial. But, the experts in this field are able to know that more than two linear acoustic transducers (1*a*) (1*b*) are possible to use serial or apparel connection with various kinds of way. Thus, it is reasonable that these modified embodiments are included in the scope of the technical thoughts according to the invention.

Embodies of the invention, as described above and illustrated in Figures, it does not have to be interpreted as limit the technical thoughts of the invention. The scope of the protection of the invention is limited only by articles of described at the scope of claim; person who has a common knowledge for technical field of the invention is able to modify the technical thoughts in various kinds of form. Thus, these modification and improvement, as reasonable for person who has a common knowledge, should be included in the protection scope of the invention.

Usability on Industries

Linear acoustic transducer according to the invention, as low frequency speaker, is applicable to acoustic apparatus, automobile, display and etc.

What is claimed is:

1. A linear acoustic transducer, comprising:

a cylindrically shaped housing having a plurality of open portions;

a driver disposed in one tip portion of the cylindrically shaped housing and generating vibration in response to an external electric signal;

a driving rod disposed vertically at an inner center of the cylindrically shaped housing and connected to the driver;

a plurality of diaphragms connected to the driving rod at regular intervals and connected to the cylindrically shaped housing; and a plurality of partitions disposed at an inner side of the cylindrically shaped housing to close a gap between the plurality of diaphragms and having a penetration hole through which the driving rod penetrates, wherein the linear acoustic transducer is configured to generate acoustic sound by air compression and expansion between the plurality of diaphragms and the plurality of partitions due to vibrations of the driver and the diving rod, wherein the driver includes a yoke, a magnet and an upper plate, and wherein a cylindrical bobbin wrapped by a voice coil is disposed at an air gap between the yoke and the magnet, and a damper is disposed at an outer circumference surface of the cylindrical bobbin, wherein the cylindrically shaped housing includes a diaphragm fixing portion to fix the plurality of diaphragms, a damper fixing portion to fix the damper, and a driver fixing portion to fix the drive, wherein the diaphragm fixing portion has a plurality of laminated diaphragm fixing sections, wherein each of the plurality of the laminated diaphragm fixing sections includes a diaphragm section main body having a cylindrical shape, wherein an upper tip of the diaphragm section main body is coupled to one of the plurality of the diaphragms, and wherein one of the plurality of the partitions is integrally disposed at a center portion of the diaphragm section main body.

2. The linear acoustic transducer of claim 1, wherein the plurality of the diaphragms comprises a center diaphragm disposed at a center of the plurality of the diaphragms and an edge diaphragm disposed at an edge of the plurality of the diaphragms, and wherein the center diaphragm has a cone shape, a center portion protruding downwards, and a fixing hole disposed at the center of the center diaphragm to fix the driving rod.

3. The linear acoustic transducer of claim 2, wherein the fixing hole of the center diaphragm is coated with an adhesive agent, and the penetration hole of the plurality of the partitions is coated with a lubricant agent.

4. The linear acoustic transducer of claim 1, wherein each of the plurality of the partitions has a cone shape and a center portion protruding downwards, and wherein the penetration hole that is penetrated by the driving rod is disposed at the center of each of the partitions.

5. The linear acoustic transducer of claim 1, wherein the diaphragm section main body comprises a single step disposed at an inner upper portion of the diaphragm section main body to fix one of the plurality of the diaphragms, a ring shaped protrusion portion which protrudes upward at an upper outer portion of the diaphragm section main body, and a ring shaped cupping portion which corresponds to the ring shaped protrusion portion and disposed at a lower circumference surface of the diaphragm section main body.

6. The linear acoustic transducer of claim 1, wherein the driver fixing portion includes a single driver fixing section, and wherein the single driver fixing section includes a driver section main body having a fixing cupping to fix the driver, a circular shaped protrusion portion which is upwardly protruded at an inner upper portion of the driver section main body, a single step to fix an edge of an inner damper at the inner upper portion of the driver section main body, and a ring shaped cupping protrusion portion which is upwardly protruded at an outer upper portion of the driver section main body.

7. A linear acoustic transducer, comprising:

a cylindrically shaped housing having a plurality of open portions;

a first driver disposed in an upper portion of the cylindrically shaped housing and generating vibration in response to an external electric signal;

a second driver disposed in a lower portion of the cylindrically shaped housing and generating vibration in response to the external electric signal;

a first driving rod disposed at a center of the cylindrically shaped housing and connected to the first driver;

a second driving rod disposed at the center of the cylindrically shaped housing and connected to the second driver;

a plurality of first diaphragms connected to the first driving rod at regular intervals and connected to the cylindrically shaped housing;

a plurality of second diaphragms connected to the second driving rod at regular intervals and connected to the cylindrically shaped housing; and a plurality of partitions disposed at an inner side of the cylindrically shaped housing to close a gap among the plurality of first or second diaphragms and having a penetration hole through which the first or the second driving rod penetrates, wherein each of the first and second driving rods has an end and is disposed at the center of the cylindrically shaped housing, and the ends of the first and second driving rods are spaced apart by a distance, wherein each of the first and second drivers includes a yoke, a magnet and an upper plate, and wherein a cylindrical bobbin wrapped by a voice coil is disposed at an air gap between the yoke and the magnet, and a damper is disposed at an outer circumference surface of the cylindrical bobbin, wherein the cylindrically shaped housing includes a diaphragm fixing portion to fix the plurality of diaphragms, a damper fixing portion to fix the damper, and a driver fixing portion to fix the drive, wherein the diaphragm fixing portion has a plurality of laminated diaphragm fixing sections, wherein each of the plurality of the laminated diaphragm fixing sections includes a diaphragm section main body having a cylindrical shape, wherein an upper tip of the diaphragm section main body is coupled to one of the plurality of the diaphragms, and wherein one of the plurality of the partitions is integrally disposed at a center portion of the diaphragm section main body.

8. A linear acoustic transducer, comprising a first cylindrically shaped housing having a plurality of open portions;

a first driver disposed in an upper portion of the first cylindrically shaped housing and generating vibration in response to an external electric signal;

a first driving rod disposed at an inside of the first cylindrically shaped housing and connected to the first driver;

a plurality of first diaphragms connected to the first driving rod at regular intervals and connected to the first cylindrically shaped housing;

a plurality of first partitions disposed at an inner side of the first cylindrically shaped housing to close a gap among the plurality of first diaphragms and having a penetration hole through which the first driving rod penetrates;

a second cylindrically shaped housing having a plurality of open portions and connected to a lower portion of the first cylindrically shaped housing;

a second driver disposed in a lower portion of the second cylindrically shaped housing and generating vibration in response to the external electric signal;

a second driving rod disposed at an inside of the second cylindrically shaped housing and connected to the second driver;

a plurality of second diaphragms connected to the second driving rod at regular intervals and connected to the second cylindrically shaped housing; and a plurality of second partitions disposed at an inner side of the second cylindrically shaped housing to close a gap among the plurality of second diaphragms and having a penetration hole through which the second driving rod penetrates, wherein the first and second driving rods are respectively disposed at the center of the first and second cylindrical shaped housing, wherein each of the first and second driving rods has an end, and the ends of the first and second driving rods are spaced apart by a distance, and wherein the first and second housings are connected with one another by a coupling supplementary element, wherein each of the first and second drivers includes a yoke, a magnet and an upper plate, and wherein a cylindrical bobbin wrapped by a voice coil is disposed at an air gap between the yoke and the magnet, and a damper is disposed at an outer circumference surface of the cylindrical bobbin, wherein the each of the first and second cylindrically shaped housings includes a diaphragm fixing portion to fix the plurality of diaphragms, a damper fixing portion to fix the damper, and a driver fixing portion to fix the drive, wherein the diaphragm fixing portion has a plurality of laminated diaphragm fixing sections, wherein each of the plurality of the laminated diaphragm fixing sections includes a diaphragm section main body having a cylindrical shape, wherein an upper tip of the diaphragm section main body is coupled to one of the plurality of the diaphragms, and wherein one of the plurality of the partitions is integrally disposed at a center portion of the diaphragm section main body.

9. The linear acoustic transducer of claim 8, wherein the coupling supplementary element has a cylindrical coupling section main body disposed inside at a center of the coupling supplementary element and has a third partition configured to close the first and second cylindrically shaped housings.

10. The linear acoustic transducer of claim 8, wherein the coupling supplementary element is disposed at one end of the first housing, and has a cylindrical coupling section main body disposed inside at a center of the coupling supplementary element and has a third partition configured to close the first and second cylindrically shaped housings.

11. A linear acoustic transducer, comprising:

a cylindrically shaped housing having a plurality of open portions;

a driver disposed in one tip portion of the cylindrically shaped housing and generating vibration in response to an external electric signal;

a driving rod disposed vertically at an inner center of the cylindrical shaped housing and connected to the driver;

a plurality of diaphragms connected to the driving rod at regular intervals and connected to the cylindrically shaped housing; and a plurality of partitions disposed at an inner side of the cylindrically shaped housing to close a gap between the plurality of diaphragms and having a penetration hole through which the driving rod penetrates, wherein the linear acoustic transducer is configured to generate acoustic sound by air compression and expansion between the plurality of diaphragms and the plurality of partitions due to vibrations of the driver and the diving rod, wherein the driver includes a yoke, a magnet and an upper plate, and wherein a cylindrical bobbin wrapped by a voice coil is disposed at an air gap between the yoke and the magnet, and a damper is disposed at an outer circumference surface of the cylindrical bobbin, wherein the cylindrically shaped housing includes a diaphragm fixing portion to fix the plurality of diaphragms, a damper fixing portion to fix the damper, and a driver fixing portion to fix the drive, wherein the damper fixing portion includes a damper fixing section having a cylindrical shape, and wherein the damper fixing section includes a coupling plate connected to the driving rod and disposed at an upper portion of the damper fixing section, and a damper section main body having a circular pressure ring portion to press the upper portion of the damper and located at an inner lower side of the damper fixing section.

12. The linear acoustic transducer of claim 11, wherein the damper section main body includes a single step disposed at an inner side of an upper portion of the damper section main body to fix the coupling plate, a ring shaped protrusion portion which protrudes upward at an outer upper portion of the damper section main body, and a ring shaped cupping portion corresponding to the ring shaped protrusion portion and disposed at a lower circumference surface of the damper section main body.

13. The linear acoustic transducer of claim 12, wherein the coupling plate includes a coupling center diaphragm and a coupling edge diaphragm disposed at an edge of the coupling center diaphragm, and wherein the coupling center diaphragm includes a fixing cupping which fixes the driving rod by insertion at a lower portion of the coupling center diaphragm, and a coupling cupping which couples the driving rod at a lower center portion of the coupling center diaphragm.

14. A linear acoustic transducer, comprising:

a cylindrically shaped housing having a plurality of open portions;

a driver disposed in one tip portion of the cylindrically shaped housing and generating vibration in response to an external electric signal;

a driving rod disposed vertically at an inner center of the cylindrically shaped housing and connected to the driver;

a plurality of diaphragms connected to the driving rod at regular intervals and connected to the cylindrically shaped housing; and a plurality of partitions disposed at an inner side of the cylindrically shaped housing to close a gap between the plurality of diaphragms and having a penetration hole through which the driving rod penetrates, wherein the linear acoustic transducer is configured to generate acoustic sound by air compression and expansion between the plurality of diaphragms and the plurality of partitions due to vibrations of the driver and the diving rod, wherein the cylindrically shaped housing includes a diaphragm fixing portion to fix the plurality of diaphragms, a damper fixing portion to fix the damper, a driver fixing portion and a coupling supplementary element to fix the driver, wherein the diaphragm fixing portion has a plurality of laminated diaphragm section main bodies, the damper fixing portion has a damper section main body, and the driver fixing portion has a driver section main body, wherein the coupling supplementary element has a coupling section main body, wherein an alignment hole is disposed on both circumference surfaces of each of the diaphragm section main bodies, the damper section main body, the driver section main body and the coupling section main body, and wherein the diaphragm section main body, damper section main body, driver section main body and the coupling section main body are coupled upward-and-downward by two alignment pins disposed in a distance with each other and penetrating the alignment hole.

* * * * *